United States Patent [19]

Pollock et al.

[11] 4,010,779

[45] Mar. 8, 1977

[54] APPARATUS FOR RECOVERY OF VAPOR

[75] Inventors: Lyle W. Pollock; Glenn H. Dale, both of Bartlesville, Okla.

[73] Assignee: Phillips Petroleum Company, Bartlesville, Okla.

[22] Filed: Mar. 20, 1975

[21] Appl. No.: 560,402

[52] U.S. Cl. ..... 141/44; 55/88; 62/54; 220/85 VR

[51] Int. Cl.[2] ..... B65B 31/00

[58] Field of Search ..... 55/55, 88; 62/54; 141/1, 4–8, 11, 44, 45, 52, 59, 69, 82, 290, 307, 392; 220/85 VR, 85 VS

[56] References Cited

UNITED STATES PATENTS

| | | | |
|---|---|---|---|
| 2,853,149 | 9/1958 | Gosselin | 55/88 X |
| 3,714,790 | 7/1973 | Battey | 55/88 X |
| 3,771,317 | 11/1973 | Nichols | 55/88 X |
| 3,815,327 | 6/1974 | Viland | 141/52 X |
| 3,874,427 | 4/1975 | Tiggelback | 141/52 |

*Primary Examiner*—Richard E. Aegerter
*Assistant Examiner*—Frederick R. Schmidt

[57] ABSTRACT

An apparatus for recovering vapors expelled from a tank during filling. The apparatus includes a conduit arrangement for selectively conducting vapor to one of a storage tank or a vapor liquefying means. Vapor conducted to the liquefying means is contacted with refrigerated liquid for liquefaction by condensation and/or absorption. Periodically, liquid and liquefied condensable portions of the vapor are discharged from the liquefying means and are replaced with fresh liquid. A pressure controller determines the flow path of the vapor to the storage tank or the vapor liquefying means wherein only a portion of the vapor is conducted to the vapor liquefying means.

8 Claims, 1 Drawing Figure

APPARATUS FOR RECOVERY OF VAPOR

Figure 1:
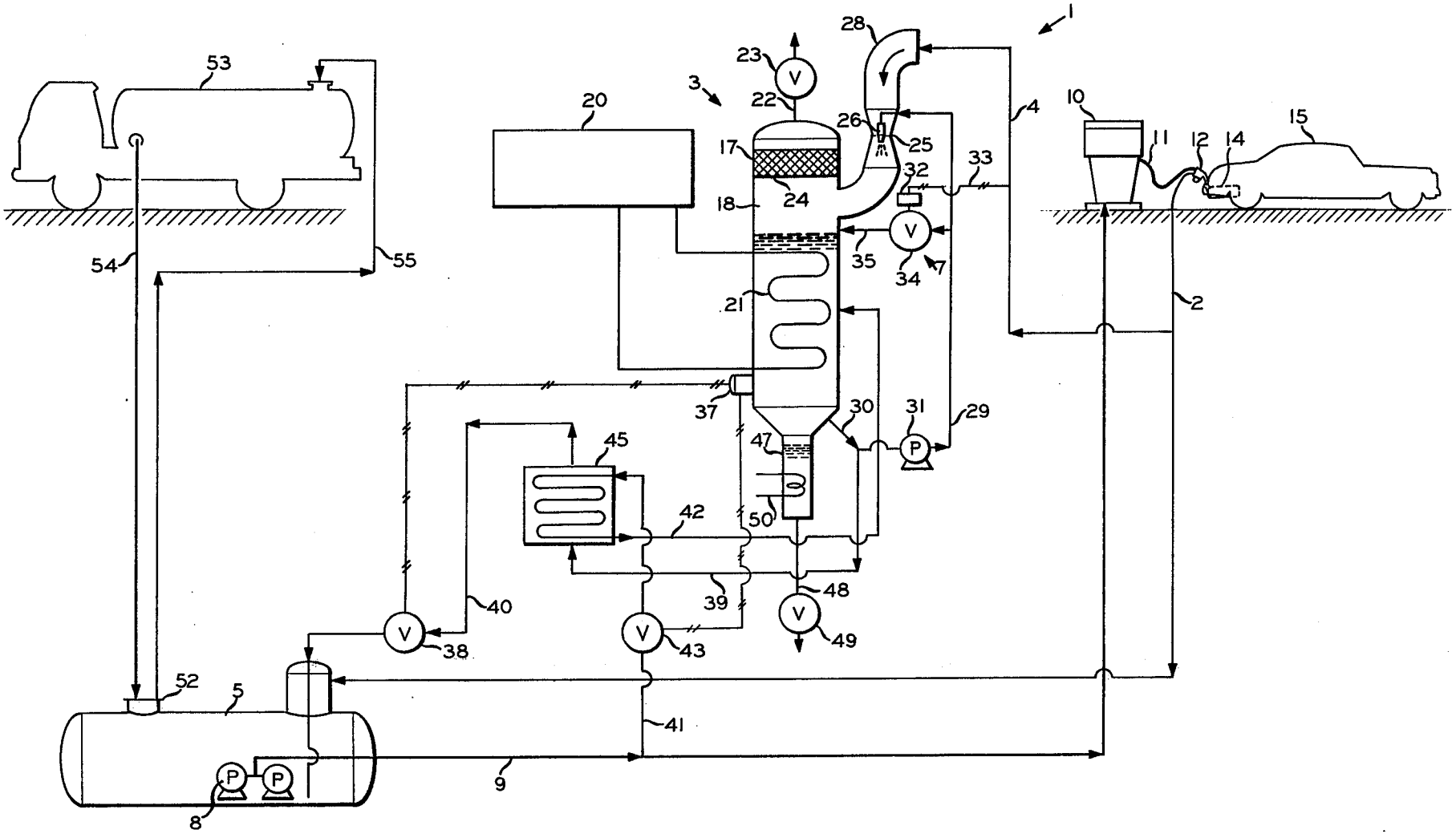

In filling tanks such as automobile gas tanks or other tanks with volatile liquids such as hydrocarbons, and, particularly gasoline, vapor comprised primarily of air, water and hydrocarbons, is expelled or displaced from the tank by the filling liquid. The vapor includes the lighter hydrocarbon components which more readily vaporize and are in substantial quantities and are discharged into the atmosphere and lost. Such vapors can pose air pollution problems, such as smog, and can, if dilute with additional air, present a fire hazard because of the combustibility of the vapors and can also present an explosion hazard. However, the vapor within the apparatus is normally outside of the combustible range. For facilities transferring large volumes of liquid, the loss can present a substantial economic loss by loss of the hydrocarbon vapors. Present apparatus for recovering vapors generally require large vapor handling capacity and are generally complicated and expensive. Although same are effective for recovering vapor, they are relatively inefficient and are of larger than necessary capacity.

The principal objects of the present invention are: to provide a method and apparatus to recover vapor expelled from a tank during filling of same with a liquid; to provide such a method and apparatus where only a portion of the vapor expelled is processed so as to reduce the operating capacity of the apparatus; to provide such an apparatus wherein water coming in with the vapor is condensed and separated from the liquid hydrocarbon in the apparatus; to provide such an apparatus wherein the vapor is liquefied by liquefying means which effects contact between a liquid phase of a hydrocarbon and hydrocarbon vapor with the liquefaction being effected by at least one of absorption and condensation; to provide such an apparatus wherein the liquid phase and vapor flow cocurrently in the liquefying means; to provide such an apparatus which is pressure controlled and preferably has a positive pressure to prevent leakage of atmospheric air into the system and where pressure is utilized to determine the flow path of vapor; and to provide such an apparatus which is well adapted for its intended use, compact in construction and efficient in operation.

Other objects and advantages of the present invention will become apparent from the following description taken in connection with the accompanying drawings wherein are set forth by way of illustration and example certain embodiments of the present invention.

FIG. 1 is a diagrammatic illustration of a vapor collecting and liquefaction apparatus.

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting but merely as a basis for the claims and as a representative basis for teaching one skilled in the art to variously employ the present invention in virtually any appropriate detailed structure.

The reference numeral 1 designates generally a vapor recovery apparatus which includes a conduit 2 which is operable to receive vapor therein for conducting same to vapor liquefaction means 3 via a conduit 4 connected to the conduit 2. The conduit 2 is also connected to a storage tank 5. Means 7 is operably associated with the conduit 2 and 4 to ultimately regulate the flow of vapor to the liquefaction means 3 whereby only a portion of expelled vapor flows to the liquefaction means 3.

In the illustrated structure the storage tank 5 includes pump means 8 which is operable to pump liquid such as gasoline from the storage tank 5 through a conduit 9 to a dispensing unit 10. The dispensing unit 10 is of conventional form, such as one commonly used at a gasoline filling station, and has a flexible conduit 11 with a filler nozzle 12 which is adapted to be received in an opening of a tank 14 such as a fuel tank of an automobile 15 or the like. The nozzle 12 is equipped with means (not shown), as is known in the art, to seal the opening of the tank 14 whereby vapor displaced by the gasoline introduced into the tank 14 flows into the conduit 2 which communicates with the interior of the tank 14. As described above, the conduit 2 is connected to both the liquefaction means 3 and the storage tank 5. The storage tank 5 is of standard construction and, as shown, is the tank used to store gasoline underground at a filling station.

Any suitable liquefaction means 3 can be used and, as shown, same include a vessel 17 having a chamber 18 therein. Preferably, refrigeration means are in heat transfer relation with the contents of the chamber 18 and, as shown, the refrigeration means includes a refrigeration unit 20, of generally standard construction which has a cooling coil 21 positioned in the chamber 18 and operable to remove heat from the liquid therein. The vessel 17 is provided with a vent 22 preferably with a pressure relief valve 23 to permit venting of non-liquefiable gases such as air from the chamber 18 to atmosphere at a predetermined pressure as determined by the relief valve 23. As shown, although not required a suitable mist-eliminating device 24 is secured in the chamber 18 and positioned adjacent the vent 22 and is operable to prevent mist from being discharged through the vent 22. Any suitable mist-eliminating device can be used such as wire mesh screens or the like.

The liquefaction means 3 includes means for contacting vapor, provided by the conduit 4 from the conduit 2, with liquid, preferably liquid from the chamber 18, to effect liquefaction of the vapor. The liquid will generally be the same filling liquid from which the vapors evolved. Any suitable contact means can be provided and, as shown, same includes a venturi 25 having a liquid dispersion nozzle 26 opening thereinto. The venturi 25 is part of a neck or conduit 28 which connects the conduit 4 to the chamber 18. The nozzle 26 is connected to a source of liquid and, as shown, a conduit 29 is connected to a lower portion of the chamber 18 by a discharge conduit 30. A pump 31 is connected to the conduit 30 and the conduit 29 to circulate liquid from the chamber 18 to and through the nozzle 26. Preferably, the nozzle 26 is directed to effect cocurrent flow of the liquid dispensed therethrough and the vapor flowing through the venturi 25 and preferably is of a type of atomize or otherwise disperse the liquid as same is discharged. The chamber 18 is adapted to contain liquid, as described above, which is substantially the same liquid as stored in the tank 5 and which is cooled by the refrigeration unit 20 and cooling coil 21 whereby the chilled liquid effects cooling of the vapor flowing through the venturi 25 and most or all of the hydrocarbons in the vapor are liquefied by condensation and/or absorption.

The means 7 is operable to control the amount of chilled liquid passing through the venturi and hence to control the amount of vapor which is drawn through the venturi 25 and the amount of vapor which returns to the storage tank 5 via the conduit 2. Any suitable control means can be used but preferably it will operate on pressure sensed in the conduit 4. In the form shown, a pressure controller 32 ensures pressure in the conduit 4 with the signal being transmitted via conductors 33. The controller 32 is operably connected to a valve 34 which is connected in a conduit 35. The conduit 35 is connected to the chamber 18 and the conduit 29 and forms a bypass for liquid flow from the conduit 29 to the chamber 18 without flowing through the nozzle 26. The valve 34 can be the on/off type as would be the controller 32 but a proportioning type valve 34 and controller 32 is preferred to regulate flow volume through the conduit 35 and thereby the flow volume through the nozzle 26 in response to pressure changes in the conduit 4. In operation of a proportioning type valve and controller, an increase in pressure in the conduit 4 will effect a reduced flow through 35 and a higher flow of liquid through the nozzle 26 to handle the increased vapor load. A decrease in pressure in the line 4 will correspondingly effect higher flow volume of vapor through the conduit 2 to the storage tank 5. Flow of vapor through the conduit 4 is induced by pressure differential between the chamber 18 and the conduit 2 which can be changed by the amount of liquid dispersed through the nozzle 26 in venturi 25 which liquefies the vapor thereby effecting a greater pressure differential and higher flow rates of vapor through the conduit 4.

In the liquefaction of hydrocarbon vapors such as gasoline vapors, normally the vapors expelled are of the lighter hydrocarbons and during liquefaction of same, the hydrocarbon liquid in the chamber 18 becomes enriched with the lighter hydrocarbons and preferably same is replaced by fresh gasoline such as from the storage tank 5. As shown, a liquid level controller 37 senses the level of hydrocarbon in the chamber 18 and is operably connected to a valve 38 which is connected to a discharge of the chamber 18 which is shown as the discharge 30 and to the storage tank 5 whereby at a predetermined level of liquid in the chamber 18 the valve will open allowing discharge of a portion of the liquefied so as to maintain a relatively constant level of liquid. The valve 38 can be a timed valve where at a predetermined interval same will open and permit discharge of liquid from the chamber 18 for return to storage tank 5 whereby the level controller 37 would be operable to override the timed operation of the valve 38 in the event the chamber 18 becomes overfull before the valve 38 is opened by timed operation. A conduit 39 is connected to the discharge 30 and is in turn connected to the valve 38 by a conduit 40 which connects the valve 38 also to the tank 5. When chamber 18 is essentially empty, valve 38 closes in response to operation of the level controller 37 thereby maintaining a predetermined quantity of liquid in the chamber 18. Fresh gasoline is supplied from the tank 5 through the conduit 9 and a conduit 41 which is connected to the chamber 18 by a conduit 42. Preferably the valve 43 is operably connected to the level controller 37 and at a predetermined level during discharge of liquid from the chamber 18 the valve 43 is opened, at about the same time the valve 38 is closed to permit filling of the chamber 18 with gasoline from the tank 5. When the level of fresh gasoline reaches a predetermined level during filling, the level controller will close the valve 43. The level after filling is preferred to be such as to maintain the cooling coils submerged. Alternately the valve 43 can be a timed valve, which would be timed to open after valve 38 closes and permits flow of a suitable amount of gasoline from the tank 5 to the chamber 18 after same has been discharged of enriched gasoline.

To improve the operating efficiency of the liquefaction means 3 a heat exchanger 45 is provided to effect heat transfer between relatively warm liquid supplied from the storage tank 5 and the relatively cold liquid being returned to the storage tank 5 from the chamber 18. The heat exchanger is connected to the conduits 41 and 42 for flow of fresh liquid from the storage tank 5 therethrough and to the chamber 18 which liquid is in heat transfer relation with enriched liquid being discharged from the chamber 18 through the conduit 39 and into the conduit 40 for return to the storage tank 5 whereby the fresh liquid is cooled before being charged into the chamber 18. Preferably, the heat exchanger 45 has a liquid holdup capacity of about the volume of liquid discharged from the chamber 18 on each cycle with the valve 38 closing, during operation, after a volume of liquid essentially equal to the liquid holdup capacity has been discharged.

Preferably the liquefaction means 3 is provided with a water trap and, as shown, a water trap 47 is positioned adjacent the lower portion of the chamber 18 and has a discharge 48 connected thereto for discharge of water. A valve 49 is connected to the discharge 48 for selective discharge of the water. It is to be noted that a liquid level controller (not shown) as is known in the art can be used to open and close the valve 48 to maintain a predetermined level of water. Such controller usually functions on a difference in specific gravity of the liquids. Preferably a heater 50 is provided to maintain the water in a liquid state in the event that the liquid in the chamber 18 is maintained at a temperature at or below the freezing point of water to thereby assure discharge of the water through the discharge 48.

The storage tank 5 has a filler 52 which is connected to a transport truck tank 53 or the like by a conduit 54 for filling the tank 5 with gasoline. A second conduit 55 also connects the vapor space of the truck tank 53 to the vapor space of the storage tank 5 to receive expelled vapors from the tank 5 when same is being filled with gasoline. In the event that the pressure in tank 5 becomes excessive, the excess vapor can flow through the conduit 2 in a reverse direction and into the conduit 4 for liquefaction similar to the liquefaction of the vapors from the tank 14.

A typical operating example is illustrated in the table below which illustrates calculated data for operating conditions and flow rates. An illustrative unit sized for use in a service station would operate on an approximate thirty minute cycle between discharge times controlled by the timed valve 38 with an expected discharge of about 15 gallons of liquid. The refrigeration unit would be sized at a maximum operating output of about 8000 BTU/hr for an average operating output of about 4600 BTU/hr.

Material Balance
For Service Station Maximum
Dispensing Rate of 32 Gal. Per Min.
(8 gal. per minute maximum per dispenser)

| | Mols Maximum Flow Rate (Averaged Over an Hour) | | | | Gallons Maximum Flow Rate (Averaged Over a Minute) | | | |
|---|---|---|---|---|---|---|---|---|
| Reference Number on FIG. 1 | 2 | 4 | 2[1] | 22 | 11 | 29 | 39 | 42 |
| Gasoline, gal/min. | | | | | 32 | 15 | 15.07 | 15 |
| Hydrocarbon Vapors, mols per hour | 0.459 | 0.046 | 0.413 | 0.004 | | | | |
| Air, mols per hour | 0.286 | 0.028 | 0.258 | 0.028 | | | | |
| Water vapor, mols per hour | 0.020 | 0.002 | 0.018 | 0 | | | | |
| Total mixed vapors, mols per hour | 0.765 | 0.076 | 0.689 | 0.032 | | | | |
| Molecular wt. of hydrocarbon vapors | 67.5 | 67.5 | 67.5 | 64 | | | | |
| Standard cu. ft. per min of mixed vapors | 4.85 | 0.485 | 4.36 | 0.20 | | | | |

1 Through conduit 2 from junction of conduits 2 and 4 to the storage tank 5.

The present invention is more fully understood by a description of the operation thereof. As the tank 14 is being filled with gasoline from the storage tank 5, vapor is expelled by displacement of same with the liquid gasoline. The expelled vapors are collected in the conduit 2 and below a predetermined pressure as controlled by the controller 32 the vapor is returned to the storage tank 5. Above the predetermined pressure, the vapor flows through the venturi 25 and most of the hydrocarbons in the vapor are liquefied by condensation and/or absorption due to contact with cold hydrocarbon or gasoline dispensed through the nozzle 26. The liquefied vapor and circulating gasoline are collected in the chamber 18 for later use in liquefaction or return to the tank 5 for later consumption. Preferably, the chamber 18 is operated at a pressure above atmospheric say, for example, 0.1 psi above atmospheric as is controlled by the pressure relief valve 23. The positive pressure in the chamber 18 and thereby the positive pressure in the various conduits prevents leakage of air and moisture into the system. Typically the gasoline in the chamber 18 would be maintained at a temperature of approximately −20° F while gasoline is supplied to the dispensing unit 10 at a temperature of approximately 80° F. Typically, more vapor is produced during the warmer months of the year and the liquefaction means would be sized to handle the highest expected amount of vapor. Normally, it would be expected that approximately 10 percent or less of the vapor expelled from the tank 14 would flow of the liquefaction means 3 by regulation of flow through the conduit 4 by the pressure controller 32. At a predetermined time interval during a time cycle, the valve 38 would open and liquid in the chamber 18 will displace the liquid in heat exchanger 45 with the displaced liquid being returned to the storage tank 5. Preferably, the heat exchanger 45 is sized to hold approximately the same volume of liquid as is dumped from the chamber 18. The valve 38 will remain open until a predetermined level, as sensed by the liquid level controller 37, is reached at which time the valve will be closed by the liquid level controller 37.

The cold gasoline contained in the heat exchanger 45 cools gasoline pumped by the pump means 8 through the conduits 9 and 41 to the heat exchanger 45 for cooling the same before it is charged into the chamber 18 via the conduit 42. Only a portion of the vapors from the tank 14 need to be liquefied by the liquefaction means 3 as a portion of the vapors can be returned to the storage tank 5 to occupy the volume vacated by pumping the gasoline into the tank 14 from the storage tank 5. This is also true of the excess vapor that is available due to filling of the storage tank 5 by the truck 53. As described above, water is collected in the trap 47 and can be periodically discharged through the discharge 48. Because of the differences of specific gravities of the hydrocarbon and the water, same are separated with water being collected in the trap 47 for eventual discharge. The amount of refrigerated or cooled gasoline from the chamber 18 dispensed through the nozzle 26 is controlled by the pressure controller 32 wherein excess gasoline is returned through the valve 34 and conduit 35 rather than flowing through the nozzle 26 whereby only the needed amount of gasoline is dispensed through the nozzle 26 as is determined by the amount of vapor flowing through the conduit 4. Excess pressure is relieved through the vent 22 as determined by the pressure relief valve 23. Normally, this excess pressure is caused by air or other gases which are not liquefied by contact with the gasoline dispensed through the nozzle 26.

It is to be understood that while we have illustrated and described certain forms of our invention, it is not to be limited to the specific form or arrangement of parts herein described and shown.

What is claimed and desired to be secured by Letters Patent is:

1. An apparatus for recovery of vapor expelled from a tank during filling of same, said apparatus comprising:

a storage tank;

b. a first conduit having a first end adapted to receive vapor from a tank being filled, said first conduit being in continuous flow communication with said storage tank;

c. a second conduit in continuous open flow communication with said first conduit;

d. liquefaction means communicating with said second conduit and operable to receive vapor from said first conduit through said second conduit for liquefying same; and e. first means operably associated with said liquefaction means and said first means including a pressure sensing means operably associated with at least one of said first conduit and said second conduit and also operably associated with said liquefaction means and being operable in response to a pressure change in one of said first and second conduits for selectively actuating a liquefying portion of said liquefaction means whereby at least a portion of the vapor selectively flows to the liquefaction means.

2. The recovery apparatus as set forth in claim 1 wherein:

a. said first means includes a pressure sensing means operably associated with said second conduit and said liquefaction means.

3. The recovery apparatus as set forth in claim 2 wherein:

a. said pressure sensing means being operably connected to said second conduit and operable for sensing pressure therein.

4. The recovery apparatus as set forth in claim 3 wherein said liquefaction means includes:

a. a vessel and a liquid-vapor contact means connecting a chamber in said vessel to said second conduit;

b. a source of liquid; and wherein c. said first means includes second means connecting a portion of said liquid-vapor contact means to said source of liquid with said pressure sensing means being operable to activate a valve to control flow of liquid through portions of said second means from said source to said liquid-vapor contact means in response to sensed pressure.

5. The recovery apparatus as set forth in claim 4 wherein:

a. said source of liquid includes said chamber; and b. said second means includes a third conduit communicating between a portion of said chamber, which is adapted to contain a liquid, and a portion of said liquid-vapor contact means, said second means further including a forth conduit communicating between said third conduit and said chamber and said valve is connected in said fourth conduit and operably connected to said pressure sensing means.

6. The recovery apparatus as set forth in claim 5 wherein:

a. said second conduit is connected to said first conduit between said first end and said storage tank for flow of vapor from said first conduit to said second conduit.

7. The recovery apparatus as set forth in claim 6 including:

a. water trap communicating with said chamber and adapted to collect water therein;

b. a heater in heat transfer relation with said water trap; and c. an outlet communicating with said water trap for selective discharge of water therefrom.

8. The recovery apparatus as set forth in claim 7 including:

a. a vent communicating with said chamber and having a pressure relief valve operable to vent said chamber at a preselected pressure; and b. mist eliminating means in said chamber positioned to prevent mist from being discharged through said vent.

* * * * *